US005322019A

United States Patent [19]

Hyland

[11] Patent Number: 5,322,019

[45] Date of Patent: Jun. 21, 1994

[54] SYSTEM FOR THE INITIATION OF DOWNHOLE EXPLOSIVE AND PROPELLANT SYSTEMS

[76] Inventor: Craig R. Hyland, 3757 Adams Rd., Magna, Utah 84044

[21] Appl. No.: 743,822

[22] Filed: Aug. 12, 1991

[51] Int. Cl.[5] ..... F42B 3/00; F42C 19/00

[52] U.S. Cl. ..... 102/312; 102/313; 102/201

[58] Field of Search ..... 102/201, 275, 312, 313

[56] References Cited

U.S. PATENT DOCUMENTS

| | | | |
|---|---|---|---|
| 4,237,972 | 12/1980 | Lanmon, II | 102/313 X |
| 4,870,902 | 10/1989 | Simon et al. | 102/201 |
| 5,022,324 | 6/1991 | Rice, Jr. | 102/201 |
| 5,148,748 | 9/1992 | Yarrington | 102/201 |
| 5,204,490 | 4/1993 | Soltz et al. | 102/201 |

OTHER PUBLICATIONS

United States S.I.R. #H1214, Liva et al., Aug. 3, 1993.

*Primary Examiner*—Peter A. Nelson

*Attorney, Agent, or Firm*—M. Reid Russell

[57] ABSTRACT

The present invention is included in an operating assembly for lowering into a wellbore on a wireline, tubular conveyance, or the like, or for use in a horizontal application, for initiating or setting off pyrotechnic, explosive, or propellant elements of that operating assembly, and comprises a firing head and an initiation assembly that are arranged for lowering into the wellbore, from a well head. The firing head provides for the extension of a striker plunger therefrom that travels into the initiating assembly to both arm it and to impact a piezoelectric device therein whose deformation generates an electrical current which fires an array of flashbulbs that excite a laser rod. The excited laser rod produces a laser beam that is passed through a fiberoptic cable or is split to pass through a plurality of fiberoptic cables to detonate initiation charges or to provide a cascading initiation of a number of initiation devices that each fire single or multiple pyrotechnic, explosive or propellant elements individually or in a cascading action.

45 Claims, 7 Drawing Sheets

SYSTEM FOR THE INITIATION OF DOWNHOLE EXPLOSIVE AND PROPELLANT SYSTEMS

BACKGROUND OF THE INVENTION

1. Field of the Invention

This invention relates to devices for the initiation of pyrotechnic, explosive, or propellant elements as are used in a wellbore and particularly to the safety of such devices both within and without the wellbore.

2. Background

The use of explosive devices within a wellbore can be traced to the early days of the petroleum industry when explosives, most notably, highly unstable nitroglycerin, were dropped free into wells to make the well "come-in" or produce. Use of explosives or propellants has, over the years, taken many forms, most notably: perforating; explosive fracturing; use of propellant (gas generator) powered devices for setting anchors or packers; tubing/casing cutting; and back-off tools. These systems must all be actuated or initiated by a deflagrating or detonating device whose function is controlled by a command action or signal. An initiating system consists of four basis elements: (1) a conveyance means to transport and locate the system within the wellbore; (2) a command path to send the firing signal; (3) an initiation charge (explosive, pyrotechnic, etc.) and (4) any safety controls or interlocks within the system. These initiating systems are generally of three types: percussive—a mechanical, impact-actuated device such as the primer in small arms ammunition; electrical—either a hot wire bridge (as the filament in a light bulb) or a spark-gap (as in an automotive spark plug); or an exploding wire or foil system in which an extremely high current is passed through the device causing a shock wave to be generated that is sufficient to cause sympathetic detonation of the initiating charge, operating similar to triggering devices utilized in nuclear devices.

Each of the above have operational problems that the present invention corrects or improves upon. Percussive systems utilize a primary, and hence sensitive, explosive as the initiator, that has a potential for sensitivity to mechanical shock. Electrically triggered systems require that wires be attached to the initiation charge, which wires can then act as antennae, making the system susceptible to accidental initiation from EMI (ElectroMagnetic Interference), RFI (Radio Frequency Interference), EMP (ElectroMagnetic Pulse), and ESD (ElectroStatic Discharge). To mitigate this potential it is not unusual for all other operations on and around the drilling rig to be curtailed or restricted during these operations. While exploding wire/foil systems are much less susceptible to accidental discharge from extraneous stimuli, they require substantial surface support and are inherently costly, thereby limiting their general usage in the industry.

The system of the present invention not only addresses the safety concerns set out above, both within and without the wellbore, by providing an enhanced insensitivity to both electric and mechanical shock stimuli, it also provides a simple to use system with attendant lower costs that make it more generally usable within the industry.

PRIOR ART

In past years a number of initiation systems and safety features designed to make systems safer, easier to utilize and more efficient for use in a typical oil field setting have been developed and utilized. Also, as the demands of oil field operations have expanded, systems have added features to keep pace. The most used initiation systems are percussive and electrical, that have essentially retained their basic features, the primer and the electric detonator. Some examples of pressure actuated firing systems are shown in patents to: Peterson, U.S. Pat. No. 4,606,409; Miller, et al U.S. Pat. No. 4,629,001; Ward, U.S. Pat. No. 4,770,246; Nelson, et al U.S. Pat. No. 4,817,718; Yates, U.S. Pat. No. 4,886,126; Rickles, et al U.S. Pat. No. 4,886,127; and George, et al U.S. Pat. No. 4,901,802, none of which firing systems are, however, similar to the present invention. Percussive systems generally involve an impact sensitive device and some examples of such systems are shown in patents to Bagley, et al U.S. Pat. No. 4,566,544 and Whiting, U.S. Pat. No. 4,629,009. Where electrical systems have progressed from simple hot-wire ignitors to capacitive-discharge and microprocessor-controlled downhole devices, the basic initiator of such systems is still a deflagrating or detonating charge that is connected to the surface through electrical wires. Such wires, of course, serve as antennae, and are accordingly susceptible to EMI, RFI, EMP and ESD. Examples of such electrical systems igniting a primer cord to fire a perforating charge are shown in patents to: Stout, et al U.S. Pat. No. 4,611,660 and Wetzel, U.S. Pat. No. 4,640,370.

Unique to the present invention the above set out safety concerns of today's energy industry are addressed. The present system provides an initiator arrangement that is shock, static-electricity and electromagnetic radiation insensitive, does not utilize impacted explosives and has no electrical wiring in the vicinity of the initiating charge that could act as an antenna. Rather the present system incorporates state-of-the art laser technology and offers not only a multitiered safety hierarchy, but a multimedia hierarchy as well. Essentially, the present system is pressure and/or temperature enabled and converts mechanical force into electricity, electricity into light, and then uses that produced light to ignite a charge through heat contained in that light. To provide a light source a number of photoflash lamps are arranged to fire electrically so as to excite a laser rod that provides a light pulse. Such photoflash lamps are well known. Examples of such are shown in patents to Decaro, et al U.S. Pat. No. 4,249,887; and to Rice, et al, U.S. Pat. No. 5,022,324. Similarly, laser systems for pulse generation are also known, and one such system is shown in a patent to Dye, U.S. Pat. No. 3,909,745. The Dye system, however, does not involve a pressure activation and shutter arrangement like the present invention, nor are any of the systems for use for controlling ignition of a downhole explosive devices.

The present invention, in its several embodiments, offers several mechanical safety features, along with electrical and optical safety features so as to ensure that no single energy stimulus can result in an accidental discharge and that the probability of the occurrence of a sequence of noncommanded events as could result in an accidental discharge is exceedingly small.

SUMMARY OF THE INVENTION

It is a principal object of the present invention in a system for the initiation of downhole explosive and propellant devices to provide an initiation system that incorporates a piezoelectric-fired, flashbulb-pumped, laser initiated system, to create an inherently safe, positively controlled, and fail-safe initiating system for igniting downhole pyrotechnic, explosive, or propellant devices.

Another object of the present invention is to provide a system that will interface with current conveyance arrangements for lowering with a downhole pyrotechnic, explosive, or propellant device into a wellbore.

Another object of the present invention is to provide a firing head that initiates an initiating system functioning on receipt of a sequence of certain electric, hydraulic and/or mechanical actions which initiating system is structured to remain inert at less than a preset pressure and/or temperature as exists at a defined depth within a wellbore.

Another object of the present invention is to provide with the initiating system that is pressure or temperature enabled at a certain downhole depth, which initiating system is disabled when it is pulled up through that depth for retrieval of the downhole explosive or propellant device from the wellbore in the event of an abortion of the operation or misfiring of any component, whereby that the initiating system is automatically rendered safe or fail-safe without operator action.

Another object of the present invention is to provide a discrete initiating system arming feature that requires a deliberate command or action by an operator to enable a firing action or command.

Another object of the present invention is to provide, as a safety feature, within an initiation assembly of the initiating system, an arrangement for electrically shorting the output of the piezoelectric device, which shorting arrangement is removable by operation of the firing head in the firing sequence.

Still another object of the present invention is to configure the system of the present invention for conveyance by wireline or tubing for lowering into the wellbore.

Still another object of the present invention is to provide, with a wireline conveyance system one or more electrical conductors in that wireline for use in transmitting command signals to the present invention that are not directly linked to the initiation charge.

Still another object of the initiation device of the present invention is to provide, as a further safety feature with the initiation system, a gap or gaps in the laser beam path to the pyrotechnic, explosive, or propellant device, whereby a fluid leakage into the system will interrupt the laser path by flooding such gap or gaps, disabling the system.

Still another object of the present invention is to provide an arrangement for splitting the laser beam output from a laser rod that is excited by the firing of an array of spark gap flashbulbs so as to provide for the detonation of a number of downhole pyrotechnic, explosive, or propellant devices.

Still another object of the present invention is to provide a system of a firing head and initiation assembly for detonating one or more downhole pyrotechnic, explosive, or propellant device that is safe and inexpensive to use.

Still another object of the present invention is to provide an initiation device whose output is split to operate a number of spaced initiation devices with the output energy of each, in turn split to individually detonate a number of downhole pyrotechnic, explosive or propellant devices providing a cascading detonation effect.

The present invention is in a downhole tool for detonating one or more pyrotechnic, explosive, or propellant devices, or groups of such devices, and consists of at least one firing head and an initiation assembly or device, which initiation assembly is set to operate only upon sensing a pressure as is present below a set depth in a wellbore. The firing head is operated mechanically, hydraulically and/or electrically to set in motion the functioning of the initiation assembly that triggers the pyrotechnic, explosive, or propellant, within the wellbore.

The firing head and initiation assembly or device along with the pyrotechnic, explosive, or propellant device are for lowering as an operating assembly into a wellbore to a desired depth. In that lowering, the device experiences an increasing pressure and temperature. The initiation assembly or device includes a pressure and/or temperature safety feature that individually enables this unit below a set wellbore depth.

The firing head is activated from the surface hydraulically, mechanically, or electrically, or on receipt of a laser beam pulse, to extend the piston out from the base thereof. The piston extension both breaks the safety or trip wire, enabling a current flow to electrical contacts of the initiation device, and provides a mechanical force to a piezoelectric device. The piezoelectric device converts that mechanical energy into electrical energy that fires a number of spark-gap flashbulbs surround the laser rod. An initiation device shutter, that is arranged to move, under pressure at depth, to align a hole therethrough, between the laser rod end and a focus lens, which shutter hole enables the laser beam to pass. The laser beam is thereby directed to the focus lens that focuses it into a fiberoptics line. The laser beam is passed therethrough, and through an optical window to create heat, in the range of three (3) joules of energy, for igniting one or more initiating charges.

The initiation system includes, as a further safety feature, an arrangement of a gap or gaps in the laser pulse path that, should the system fill with fluid, will interrupt the laser beam passage, prohibiting initiation.

The firing head and initiation device as the initiation system of the present invention, is usable with available pyrotechnic, explosive, and propellant assemblies. In use it provides both a safe and reliable igniting system for one or a number of downhole pyrotechnic, explosive, or propellant devices, or a combination thereof.

THE DRAWINGS

These and other objects and features of the present invention will become more apparent taken in conjunction with the accompanying drawings.

Figure 1:
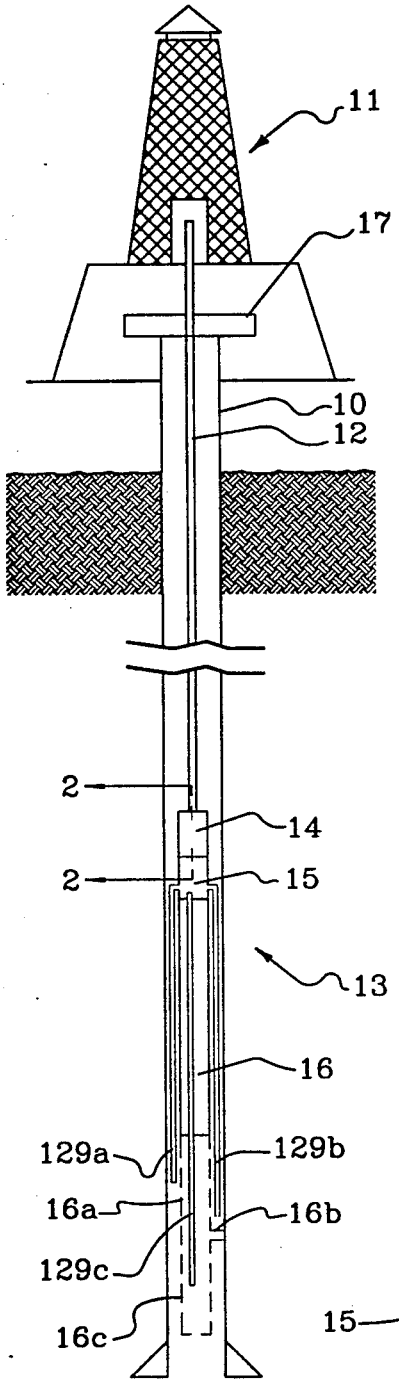
FIG. 1 shows a side elevation schematic representation of an operating assembly consisting of a downhole pyrotechnic, explosive and/or propellant initiating system of the present invention, shown suspended on an end of a wireline in a wellbore.
Figure 2A:
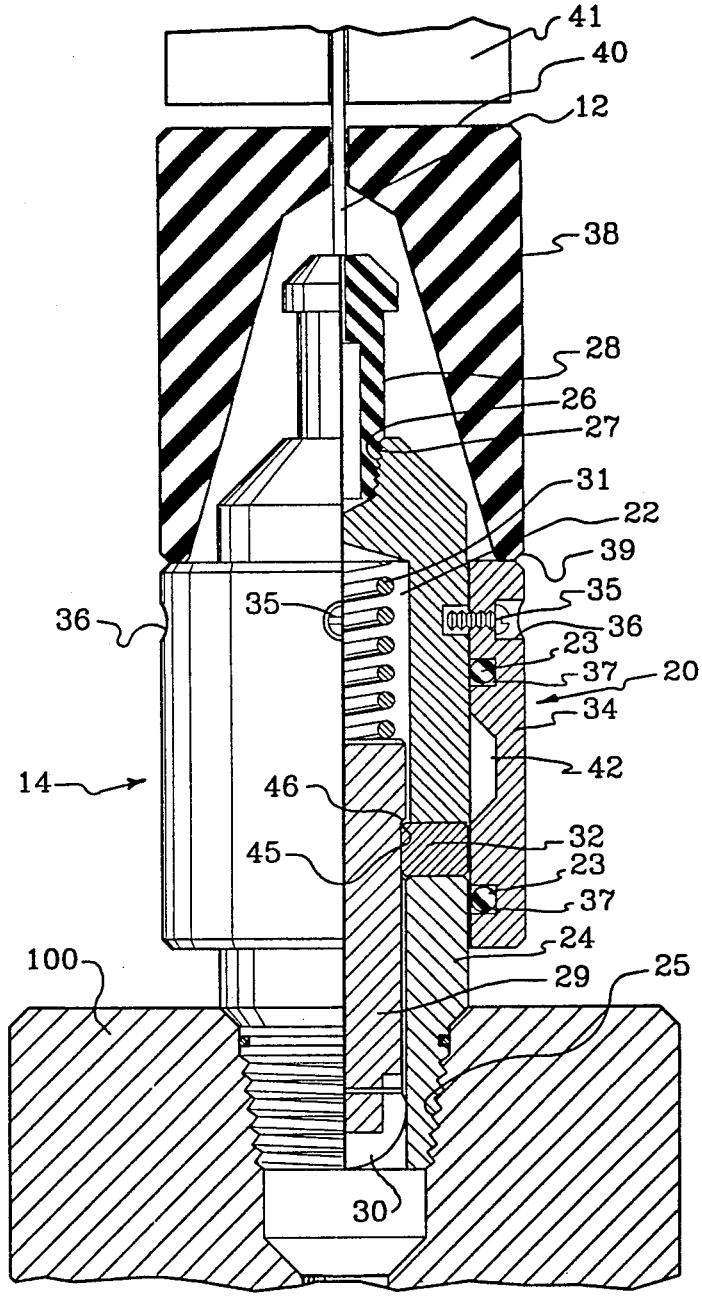
FIG. 2A shows a profile sectional view of a first embodiment of a firing head of FIG. 1, shown supported on the wireline above the initiating system, in which firing head the command and control functions are mechanical.
Figure 2G:
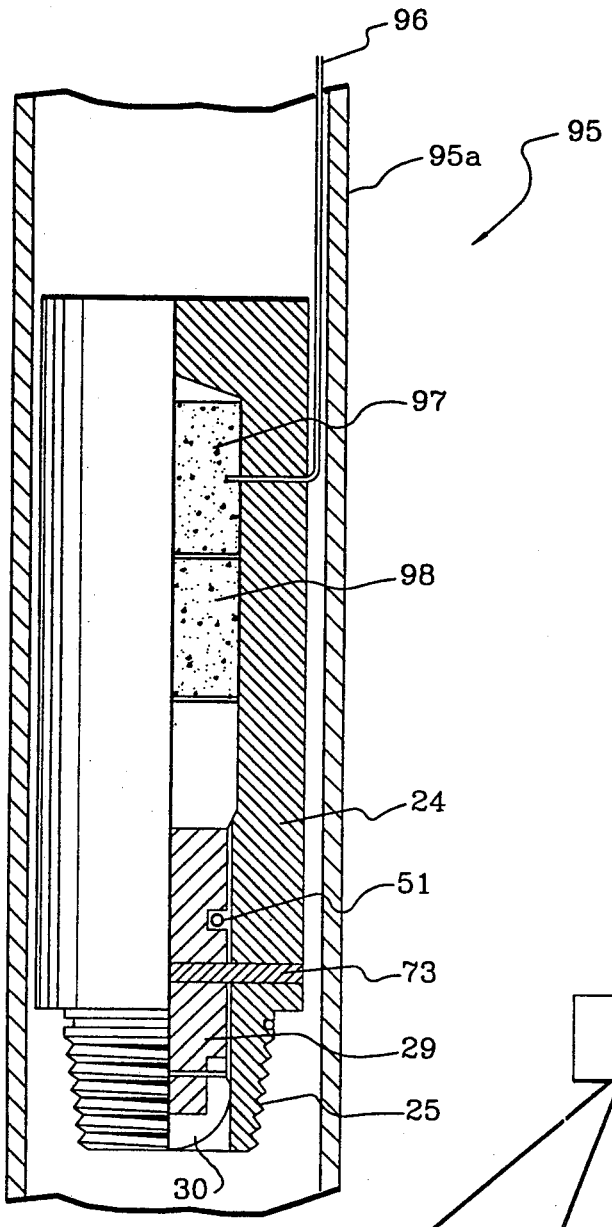
FIG. 2B shows a profile sectional view of a firing head that is like that of FIG. 2A, except that it is configured where the firing command is mechanical and is ported to fire hydraulically.
FIG. 2C shows a profile sectional view of another embodiment of a firing head that is like that of FIG. 2A, except that it is lowered in a tubing and the arming arrangement is operated by a hydraulic action that occurs within which tubing by the closure of the tubing above the system and allowing pressurization of the tubing, and firing head piston extension is provided for by a spring action.
Figure 2B:
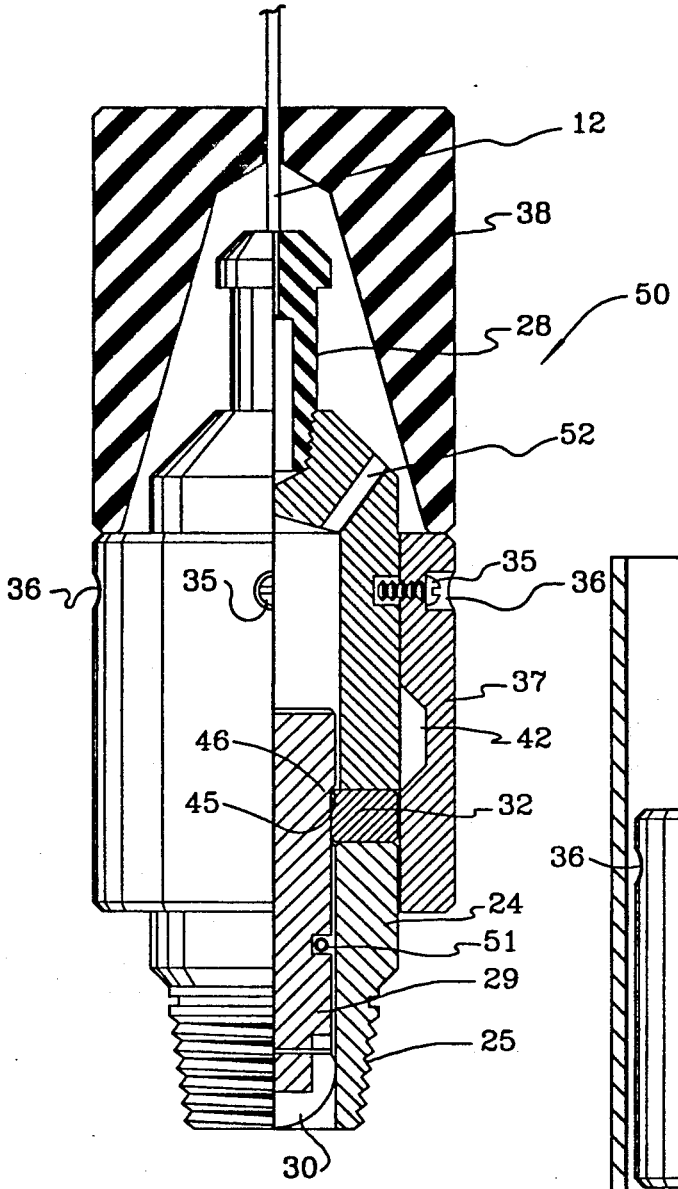
Figure 2C:
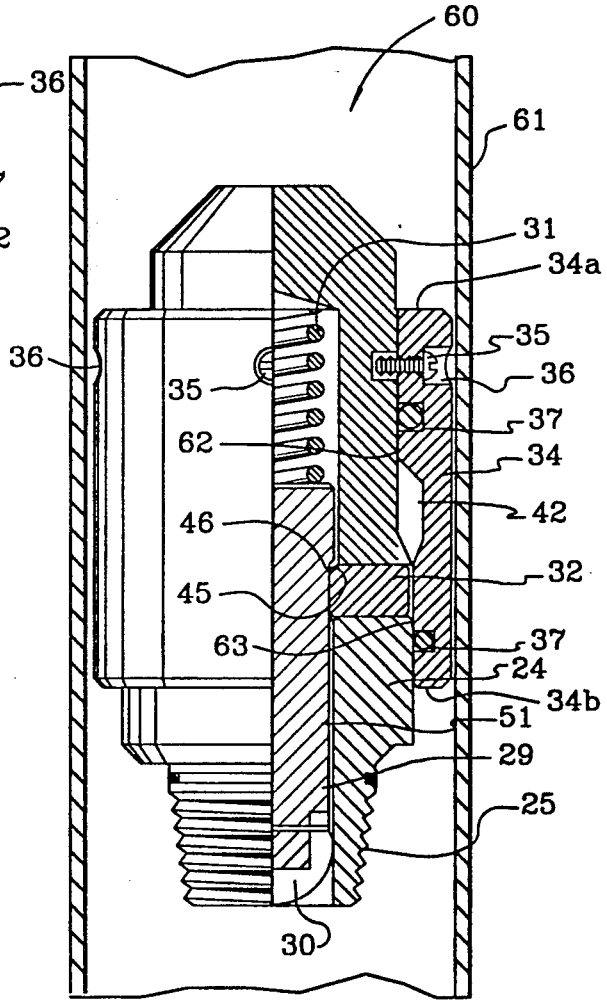
Figure 2D:
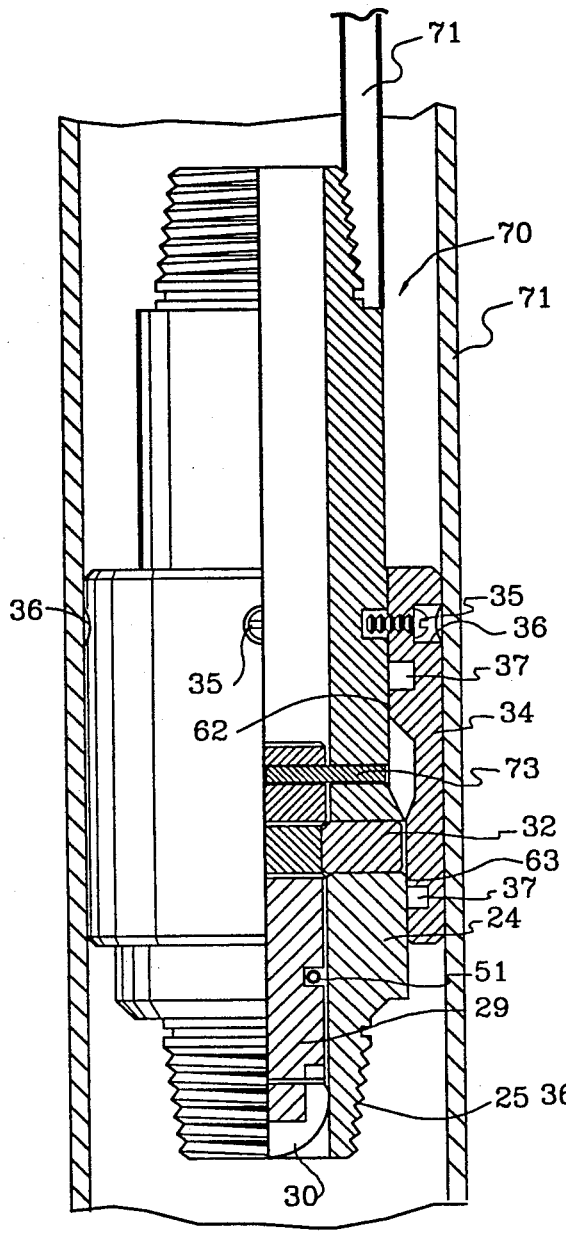
Figure 2E:
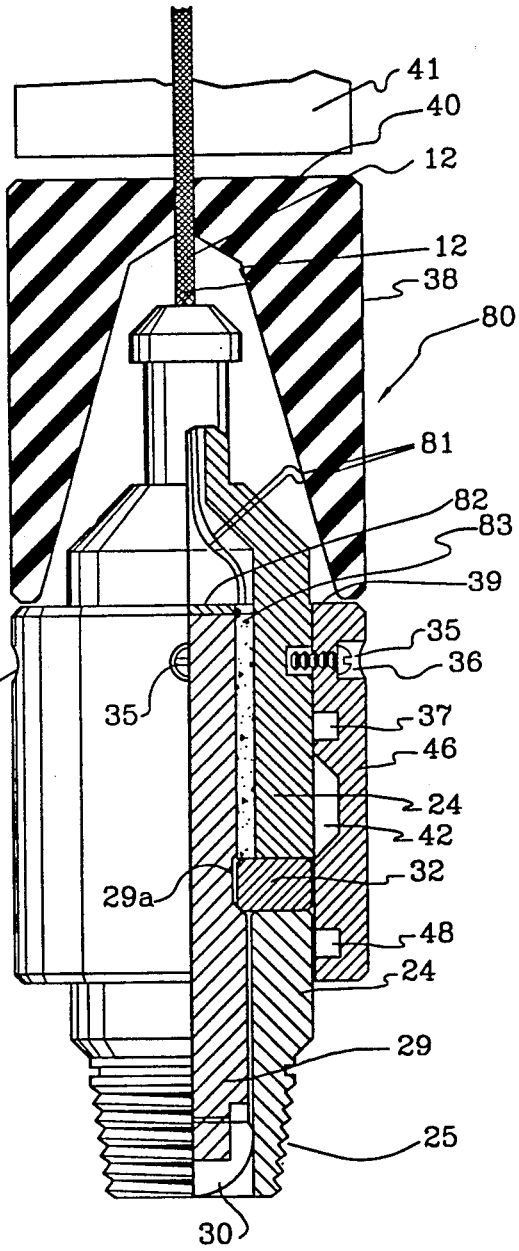
Figure 2F:
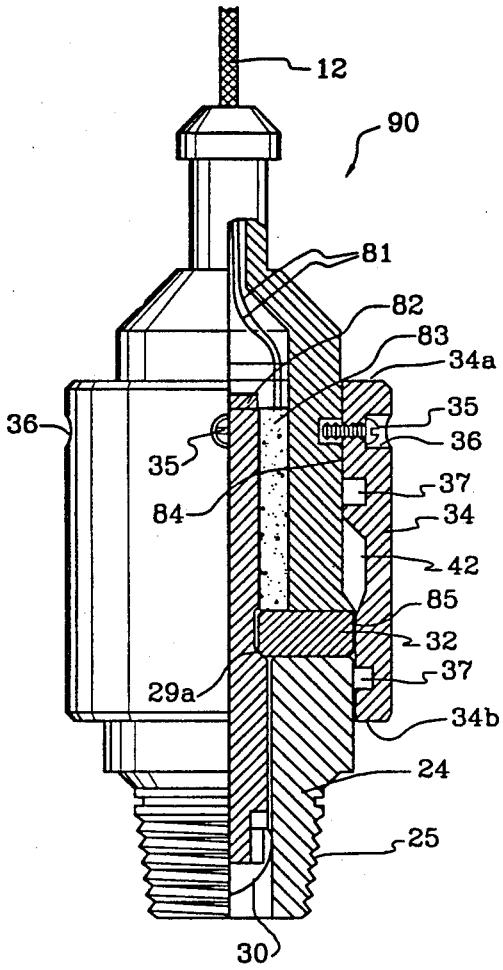
Figure 3:
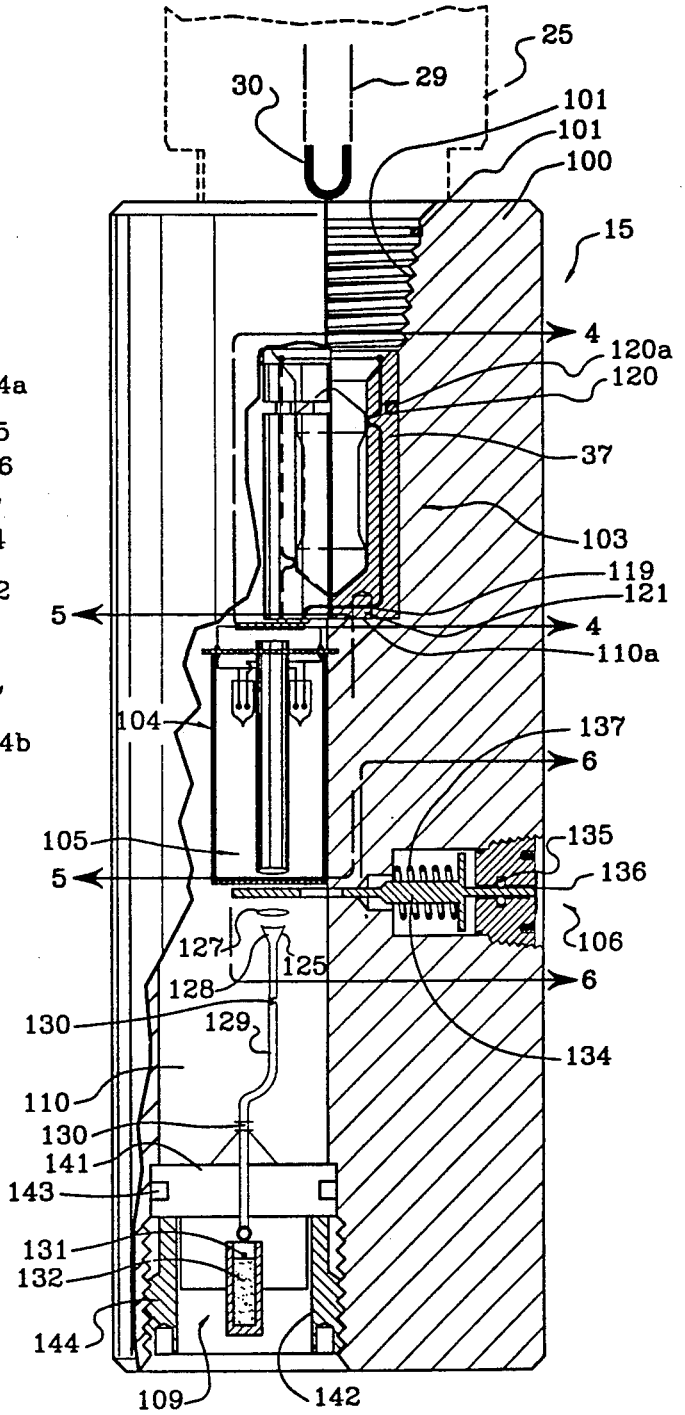
Figure 4:
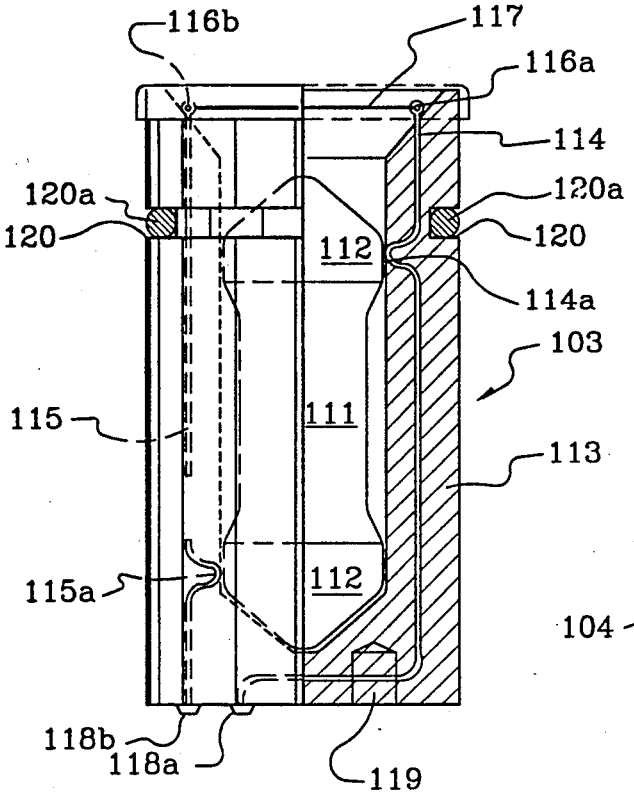
Figure 5:
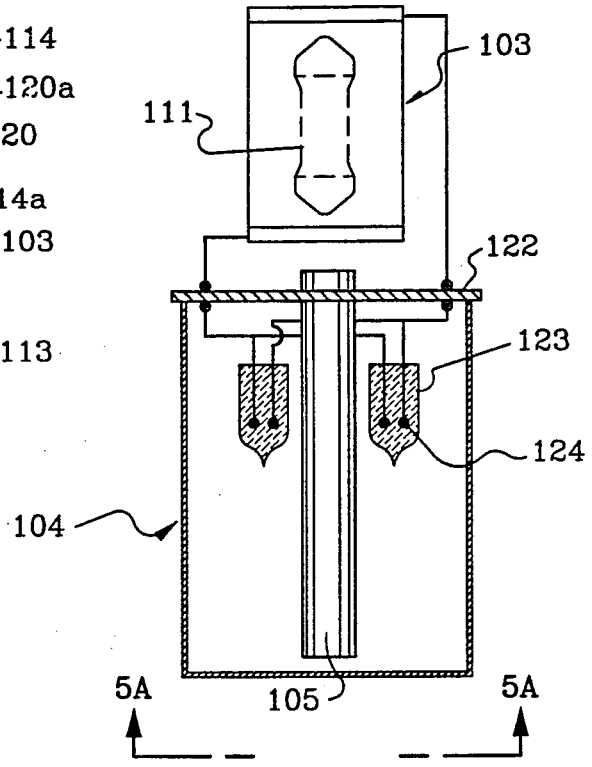
Figure 4A:
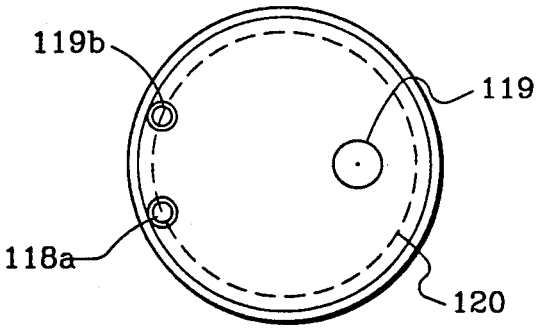
Figure 5A:
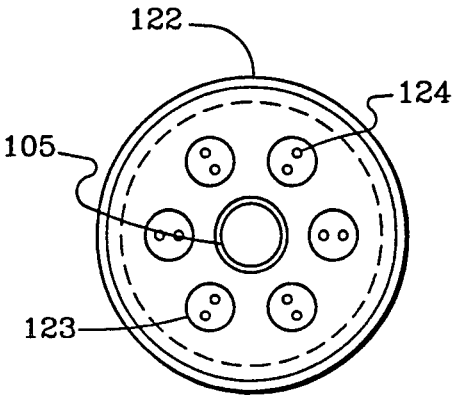
Figure 6:
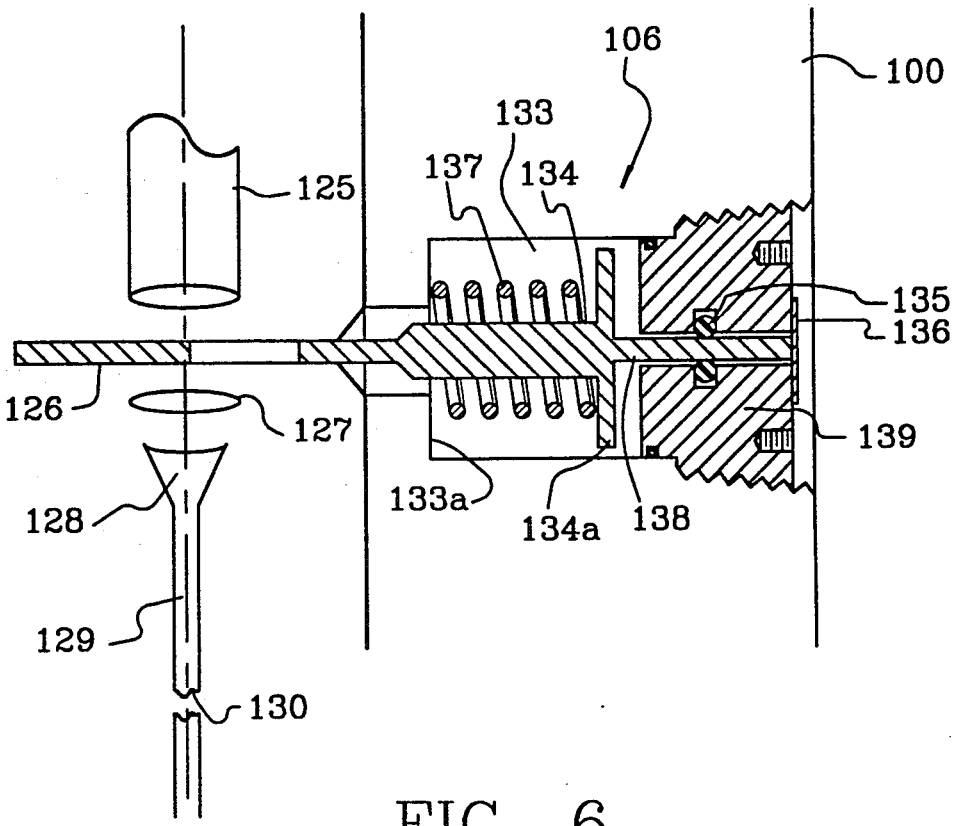
Figure 6A:
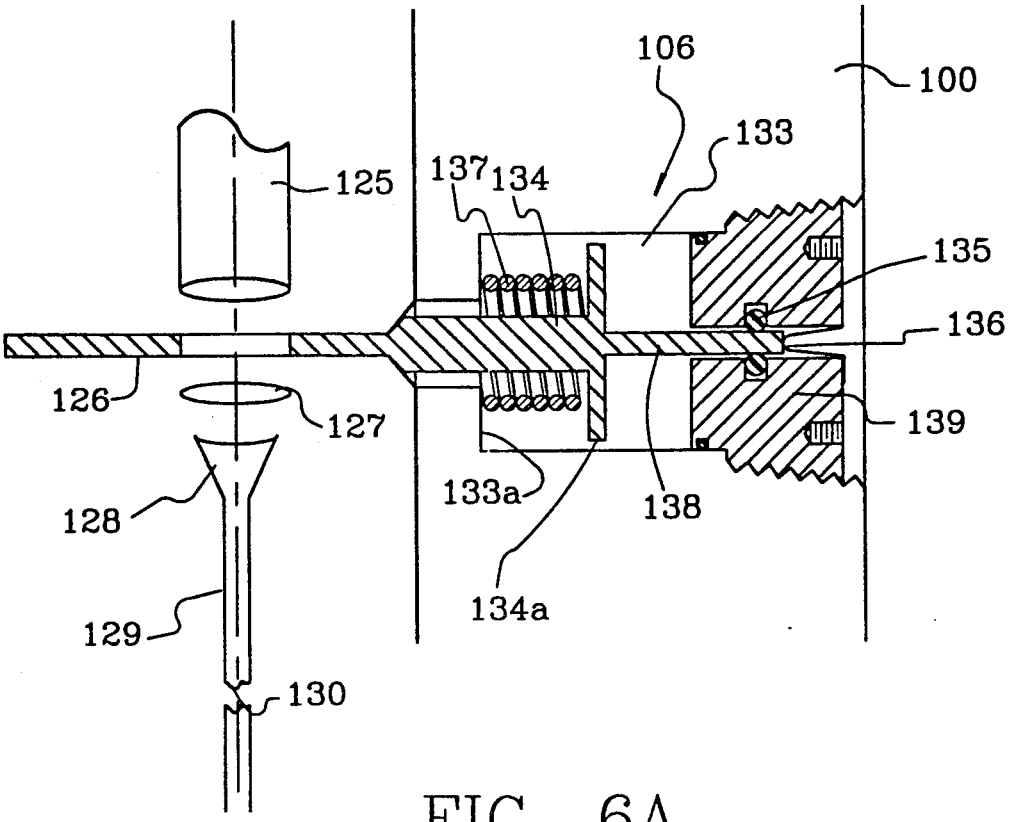

FIG. 2D profile sectional view of another embodiment of a firing head that is suspended on a tubing string and where arming is provided responsive to the presence of a sufficient annulus pressure between the tubing string and wellbore casing, with firing head piston extension the product of an increase in tubing pressure created by the surface operator;

FIG. 2E shows a profile sectional view of still another embodiment of a firing head that is shown suspended on a wireline conveyance, which wireline contains electrical conductors for providing command and control, to the firing head that is configured such that the arming step is a mechanical action provided by dropping an arming adaptor, with piston extension provided by the passing of an electrical signal that is transmitted down the wireline conductors to a solenoid;

FIG. 2F shows a profile sectional view of a firing head that is similar to that of FIG. 2E, except that it is arranged to be armed hydraulically, like the firing head of FIG. 2E, with piston extension provided for by operation of a solenoid;

FIG. 2G shows a profile sectional view of still another embodiment of a firing head to be fired on receipt of a laser beam setting off an initiation charge and booster to extend a firing head piston;

FIG. 3 shows a profile sectional view of the initiation assembly of FIG. 1;

FIG. 4 shows a cross-sectional representation of a piezoelectric element of the initiation assembly of FIG. 3, that is shown in a safe until fired configuration;

FIG. 4A shows a bottom end plan view of the piezoelectric element of FIG. 4;

FIG. 5 shows a side elevation schematic representation of a piezoelectric element fired, flashbulb-pumped, laser initiator of the initiation assembly of FIG. 3;

FIG. 5A shows a cross-sectional view taken along the line 5A—5A of FIG. 5;

FIG. 6 shows a cross-sectional view of a pressure controlled shutter of the initiation assembly of FIG. 5; and FIG. 6A shows the initiation assembly of FIG. 6 under pressure, with the shutter shown moved so as to align a shutter opening therethrough with a laser rod end and focus lens;

DETAILED DESCRIPTION

In FIG. 1 is shown wellbore 10, below a drilling rig 11, wherefrom is suspended a conveyance 12. The conveyance 12 supports an operating assembly 13 on its end that includes, as its end, a pyrotechnic, explosive, or propellant charge or charges 16, hereinafter referred to as charge, that may also be a number of charges 16*a*, 16*b* and 16*c* or a cascading arrangement of a number of charges 16*d*, to be ignited to perform the operating assembly's intended function. Which function can be explosive fracturing to stimulate production, or the like.

In FIG. 1, the charge 16 is connected to an initiation assembly 15, with a firing head 14 to operate that initiation assembly. The operating assembly 13 is for lowering into the wellbore on conveyance means 12, that can be a "slick" wireline, an electrical wireline, or a tubular line that can be any of a variety of oil country tubulars (pipes). Upon reaching the tools desired location within the wellbore at the desired depth, a series of actions are taken by an operator at the rig floor 17, as governed by the particular firing head selected as illustrated in FIGS. 2A through 2G, to arm and fire that firing head 14 that, in turn, activates the initiation assembly 15 to fire the charge 16.

The firing heads, FIGS. 2A through 2G, show cross-sectional representations of several embodiments of firing head 14. Common to all the embodiments of firing heads 14 is that each is arranged to be separately armed and then fired which firing provides a motive force to a striker plunger additional to providing for separate arming and firing each includes an attachment arrangement for joining it onto conveyance 12.

FIG. 2A shows a mechanical-mechanical firing head 20 that is configured to require a mechanical arming action followed by a mechanical firing action and is hereinafter referred to as firing head 20. The firing head 20 consists of a body 24 with a center longitudinal cavity 21, which body 24 mounts at a lower end, by turning a threaded end 25 thereof into the top of the initiation assembly 15 body 100, at its top end. The firing head body 24 includes, on a top end thereof, a threaded recess 26 that is for receiving a fishing neck 27, of a wireline socket 28 of the conveyance 12. The body 24 contains the striker plunger 29 that has a nonconducting nose 30 fixed to its end to extend beyond the firing head body lower end. The striker plunger 29 is held compressively against a compressed firing spring 31 by a plurality of locking dogs 32 that are each arranged from apertures 23 that are formed radially around and into longitudinal cavity 22 to block axial movement of the striker plunger 29. Which striker plunger 29 function is set out hereinbelow and with respect to a discussion of the initiation assembly 15.

The locking dogs 32 are likewise restrained from radial movement outwardly of the apertures 23, by a locking sleeve 34 that encircles the body 24 outer surface. Which locking sleeve 34 is shearingly restrained by a plurality of shear screws 35 that are inset into cavities 36 spaced around the locking sleeve 34. The shear screws extend into the body 24, functioning as described below. A pair of seals 37 are provided in slots formed around the sleeve inner circumference for prohibiting external fluids from entering the firing head 20, and maintaining approximately a one-atmosphere chamber pressure as is also maintained in the initiation assembly 15.

To extend the striker plunger 29 nose 30, from the firing head 20 body 24 base or bottom end, an arming adaptor 38 is slidingly dropped down the conveyance 13, that is shown as a wireline, such that a foot end 39 thereof will strike the top of the locking sleeve 34. The particular arming adaptor 38 is selected to have insufficient mass to cause failure of the shear screws 35. With the arming adaptor 38 in place, as shown in FIG. 2A, a more massive detonating bar 41 is slidingly dropped on the conveyance 12 that impacts the top surface 40 of the arming adaptor 38. This impact is transmitted into the locking sleeve to cause shearing of the shear screws 35, releasing the locking sleeve 34 to slide along the body 24. Along with the shear screw 35 failure the locking sleeve 34 is driven downwardly to where an annular recess 42 in the locking sleeve 34 aligns with the locking dogs 32 ends. Thereat, the locking dogs 32, are freed to move radially outwardly releasing the striker plunger 29. The coil spring 31 is compressed between the striker plunger top and longitudinal cavity 22 top end to urge the locking dogs 32 along apertures 23 into which locking sleeve annular recess 42. Locking dogs 32 movement is provided through the spring force acting against juxtapositioned angled surfaces of the locking dog 34 interior end 45 and an angled surface 46 that is formed around the top of the striker plunger 29. With the release of the lockings dogs 32, the coil spring 31 provides a forcible downward movement of the striker plunger 29 the nose 30 thereof traveling into the initiation assembly.

FIG. 2B shows a cross-sectional representation of a second embodiment of a firing head 50 that is a mechanical-hydraulic firing head, wherein the arming and firing actions produce the desired striker plunger 29 extension, as shown and described with respect to FIG. 2A. The firing head 50 of this second embodiment as well as the embodiments of FIGS. 2C-2F all provide for the same striker plunger 29 extension and accordingly the same numbers are used for each embodiment for identifying like components.

The firing head 50 of FIG. 2B is configured such that the force operating the striker plunger 29 is provided by the presence of a hydrostatic pressure exerted through port 52 on the area of the firing head shown as a plunger seal 51. The opposite side of which, without the body 24 is the pressure within the wellbore casing. The firing head 50, like firing head 20 is enabled by dropping an arming adaptor 38 down the line 12, which arming adaptor alone or with a bar dropped therewith is, however, sufficiently heavy to shear the shear screws 35 to allow the locking dogs 32 to travel into annular recess 42, enabling firing head 50 to fire.

FIG. 2C shows a cross-sectional representation of a third embodiment of a firing head 60, that is a hydraulic mechanical firing head. Firing head 60 is intended to be conveyed in a tubing system 61 as the conveyance 12. In this embodiment, the firing head 60 attached to the initiation assembly 15 is configured to be contained with a wellbore pipe. Tubing system 61 is arranged to have a closable circulating means connecting the tubing interior with the wellbore annulus, which arrangement is well known in the art. To fire firing head 60, the aforementioned circulating means is closed (a mechanical action) and tubing pressure is increased so as to create a downward force on the top surface 34*a* of locking sleeve 34 that is shown as having a greater surface area than does a stepped bottom end 34*b*. The greater pressure urges the locking sleeve 34 downwardly and is sufficient to shear shear screws 35, the locking sleeve 34 traveling opposite to the greater applied pressure to where the annular recess 42 aligns with the locking dog 32 ends that function as described with respect to FIG. 2A. This pressure differential is directed against outside of seals 37, that maintain the area therebetween at approximately a one-atmosphere pressure between. Firing of firing head 60 occurs with the shearing of shear screws 35 and movement of the locking sleeve 34 to align the annular recess 42 with so as to release the locking dogs 32 releasing firing spring 31, as described above.

FIG. 2D shows a cross-sectional representation of a fourth embodiment of a firing head 70 that is hydraulic-hydraulic, and like firing head 60, is also for use in a tubing system 71 as the conveyance system 12. Firing head 70 exterior is exposed to the wellbore annulus pressure. To fire firing head 70, extending plunger 29, wellbore annulus pressure between an annulus tube 71 and tubing string 72 is utilized to shift the locking sleeve 34, functioning similarly to the description of firing head 60, set out hereinabove with respect to FIG. 2C. In this firing head 70 embodiment, pressure within the firing head 70 housing 25, contained by seal 51, is increased to act upon the top area of the plunger 29 until sufficient force is generated to cause failure of a shear pin 73, that shears to allow the pressure built-up within firing head housing to act on so as to propel the striker plunger 29 into the initiation assembly 15.

FIG. 2E shows a cross-sectional representation of a fifth embodiment of a firing head 80, that is mechanical-electrical. Firing head 80 is intended to be utilized with a wireline as the conveyance system 12. In which wireline is contained either one or a plurality of electrical conductors 81. The conductors 81 extend to the drilling rig floor 17 and are capable of transmitting command and control signals therethrough. Firing head 80 utilizes a mechanical arming feature that is like that shown and described with respect to FIGS. 2A and 2B, but is electrically fired.

Like the previous embodiments, set out in FIG. 2A and 2B, the firing head 80 locking sleeve 34 is slidingly and sealing maintained to the firing head body 25 in such a manner as to radially restrain locking dogs 32 in an interference position with recesses 29*a* formed in striker plunger 29. Axial movement of striker plunger 29 is thereby restrained until an arming adaptor 38 is dropped slidingly along the wireline 12, solidly striking the top 39 of the locking sleeve 34 that is of sufficient weight or is followed by a detonating bar 41 also dropped along wireline 12 to cause shearing of the shear screws 35. The locking sleeve 34 is thereby moved downwardly until the locking sleeve recess 42 is opposite to the locking dogs 32, allowing them to move radially into that recess releasing the striker plunger 29. Firing head 80, as shown in FIG. 2E, does not include a spring biasing of the striker plunger 29 to extend it, as described. Which striker plunger is constrained in its upward position, as shown, by a plunger retainer 82 that can be a magnetic or mechanical lock. After locking sleeve's 34 downward movement to arm the firing head 80, an electrical firing command is transmitted through the conductors 81, that are arranged within the wireline conveyance 12. The electrical current then flows through a solenoid coil 83 that provides a forcible downward movement to the striker plunger 29, the plunger nose 30 traveling into the initiation assembly 15.

Like the above firing head 80, a firing head 90 that is another or sixth embodiment of firing head 14, as shown in FIG. 2F, is a mechanical-electrical firing head. In this embodiment the locking sleeve 34 is like that shown in FIGS. 2C and 2D, and is arranged around dissimilar interior locking sleeve surface, providing for hydraulically arming of which firing head, as described with respect to FIGS. 2C and 2D. Which firing head 90 is then electrically fired, like the firing head 80, described with respect to FIG. 2E.

Figure 1A:
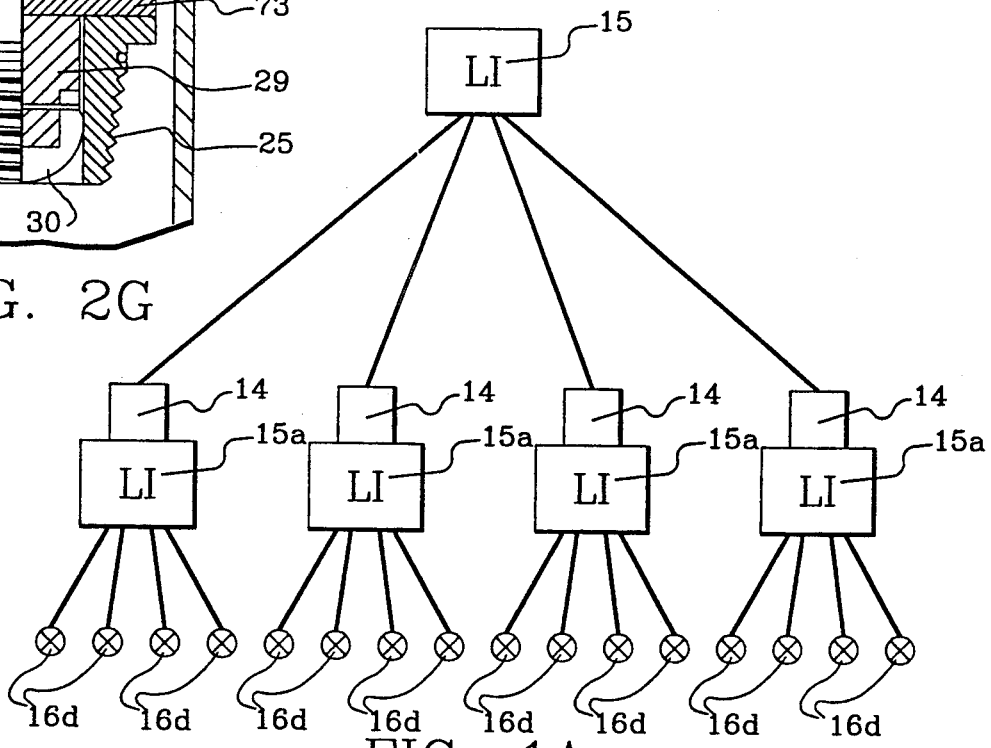
FIG. 1A shows a block flow schematic of a cascading firing arrangement for firing or detonating a number of downhole pyrotechnic explosive and/or propellant devices.

Distinct from the firing heads of FIGS. 2A-2G, a firing head 95 of FIG. 2G is arranged to be laser beam activated. In the schematic of FIG. 1A, an initiation assembly 15 is shown connected to a number of firing heads 14 each to receive a laser beam that is produced by a division at which initiation assembly 15. Each laser beam, received at a firing head 14, shown at 95 in FIG. 2G, contained within a housing 95*a* is the laser beam passed through a fiberoptics line 96 into, to detonate an initiation charge 97 that fires a booster 98. Booster 98 firing creates a gas pressure that acts on the head end of striker plunger 29. The striker plunger 29 is thereby extended, as described, into an initiation assembly 15*a*, of FIG. 14. The laser beam output from which initiation assembly functioning is split to detonate a number of pyrotechnic, explosive, or propellant charges 16*d*, providing a cascade firing of which charges. In the arrangement of FIG. 1A, a large number of charges 16*d* can be fired by the operation of a single initiation assembly 15.

Hereinabove have been shown and described seven embodiments of firing heads that all provide the functioning of firing head 14, all of which are operated to forcefully extend the striker plunger 29 longitudinally from the bottom end thereof, the plunger nose 30 thereof traveling into the connected initiation assembly 15, that both arms and fires that initiation assembly, as set out below.

FIG. 3 shows a cross-sectional representation of a preferred embodiment of the initiation assembly 15 of the present invention. The initiation assembly consists of the initiation assembly housing or body 100 having a firing head coupling recess 101 formed therein that has been machined to receive and couple to the end 25 of the firing head 14 and includes a longitudinal cavity 110 wherein the components of the initiation assembly are arranged as set out below. This coupling includes a seal 102 and includes a passage to accommodate the extension of the firing head striker plunger 29 into the initiation assembly 15. Within the initiation assembly is shown a piezoelectric fired, flashbulb-pumped, laser initiator, hereinafter referred to as laser initiator, that consists of a piezoelectric device 103, a flashlamp laser module that includes spark-gap flashbulb assembly 104, and a laser rod assembly 105, an optical shutter assembly 106, a focus lens 127, a fiberoptics connector 128, and a fibertoptics line 129 that connects into an initiating can 109. These components, their attendant constituents are further set out and described herein below with respect to discussion of FIGS. 4, 4A, 5, 5A, 6, and 6A.

FIG. 4 shows a cross-sectional representation of an embodiment of the piezoelectric device 103 and its attendant circuitry. The piezoelectric device includes a piezoelectric element 111 that may be a crystal or ceramic formed of Lead Zinconcium Titanate (PZT), quartz, or similar piezoelectric material that includes electrically attached conductive metal caps or electrodes 112. The assembly is contained within a nonconductive housing 113, that includes circuitry 114 and 115 that have been molded therein such that electrical contacts, shown at 114*a* and 115*a*, are in contact with the crystal's electrode ends 112. The two, circuits 114 and 115, terminate on the device top end at eyelets or terminals 116*a* and 116*b*. Across which terminals 116*a* and 116*b* is arranged a fine conductive wire 117. The fine conductive wire is hereinafter referred to as the trip wire 117, and is for creating an electrical short across the piezoelectric device 103.

The opposite ends of which circuits 114 and 115, to terminals 116*a* and 116*b*, respectively, terminate in contacts 118*a* and 118*b* that are shown in FIG. 4A and are for making electrical connection with circuitry that connects to the spark-gap flashbulbs 123 of the flashbulb assembly 104. An orienting hole 119 is provided in the base of the piezoelectric device 103 for receiving a pin 121 extending upwardly from a stepped section 110*a* from an interior wall of which longitudinal cavity 110, to insure that the piezoelectric device 103 will be properly oriented so as to be electrically engaged when installed in the initiation assembly body 100 longitudinal cavity 110. Further, an O-ring 120*a* is provided in a groove 120 as a retainer to secure the piezoelectric device 103 within the initiation assembly housing 100.

FIGS. 5 and 5A show a simplified representation of the flashbulb assembly 104 of the laser initiator, that is shown herein as a single unit. It shall be understood however, that a number of such units could be so employed, individually or collectively fired by the operation of the firing head plunger, as described above, the current generated in that firing connected to fire each flashbulb assembly, with each to initiate or fire one or a number of separate initiation charges. Which flashbulb assembly 104 is shown arranged to receive the electrical energy that results from the application of a mechanical force on the piezoelectric crystal 111 by the extension striker plunger 29, as set out above, from the firing head 15. To break the trip wire 117 and compress the piezoelectric crystal 111, and the produced voltage through attendant coupling and circuitry 122. Which electrical energy is thereby transmitted to a plurality of spark-gap flashbulbs 123 that are arranged, as shown best in FIG. 5A, around the laser rod assembly 105 that is preferably made of a material such as neodymium glass, or the like. Which spark-gap flashbulbs 123 preferably each have pyrotechnically coated electrodes 124, that ensure the flashbulb activation on receipt of the current flow.

The optical shutter assembly 106 is shown mounted in the housing 100 transverse cavity 110 in FIG. 3 and removed in FIGS. 6 and 6A, and is a device which will block or allow the passage of light, in the form of a laser pulse from the laser rod assembly 105. A shutter 126 of the optical shutter assembly 106 in FIG. 6A, in an open attitude with a hole therethrough aligned to pass the laser beam or pulse to focus lens 127. The laser beam or pulse is focused by the focus lens 127 into a fiberoptics connector 128 that is connected to route it into the fiberoptic line 129. In the fiberoptic line 129 the beam travels across a gap or gaps 130 that are preferably formed therein and are discussed below. Which fiberoptics line gap or gaps have dome-shaped or angled opposing surfaces such that an introduction of a fluid, other than a gas, therebetween, results in a refractive scattering of the laser beam that effectively interrupts the laser beam. Shown in FIG. 3, the laser beam or pulse from fiberoptic line 129 is passed through an optical window 131 and into an initiating charge 132 maintained in the initiating can 109. This laser beam or pulse introduced through the optical window 131 creates heat upon striking the initiating charge in initiating can 109, that results in the ignition of the initiating charge 132. Which initiating charge 132 ignition results in the firing of the deflagrating or detonating charge 16, shown in FIG. 1. Additionally, as shown in broken lines in FIG. 1, additional deflagrations or detonating charges 16*a*, 16*b*, and 16*c*, can be arranged in the wellbore 10 for detonation by passage of a laser beam or pulse passed thereto. The laser beam or pulse is passed thereto through fiberoptics lines 129*a*, 129*b*, and 129*c* from one or more initiation assemblies 15, providing a cascade type firing of the deflagrating or detonating charges. In practice, the laser rod output is approximately three (3)

joules, which is approximately one hundred (100) times the power needed to set off the initiating charge. Accordingly, the laser beam or pulse lends itself to being split to simultaneously pass to a number of deflagrating or detonating charges, providing a cascade firing thereof.

FIGS. 6 and 6A show cross-sectional representations of the pressure controlled optical shutter assembly 106, hereinafter referred to as the optical shutter assembly 106. The optical shutter assembly 106 is contained within a shutter actuator cavity 133, that extends inwardly from the housing 100 surface to intersect the longitudinal cavity 110. A shutter piston 134 is connected axially to the shutter 126 end, the shutter to travel back and forth in the initiator assembly body cavity 110. The opposite shutter piston section 138 is shown arranged for axial travel across a seal 135, and terminates in an end that is juxtapositioned to a diaphragm 136. The diaphragm 136 is a flexible membrane and is positioned across an opening to the exterior wall of the initiation assembly housing 100 to exclude foreign material. The diaphragm 136 is directly affected by pressure conditions outside the initiation assembly body pressure without the housing 100 forcing that diaphragm to flex inwardly against the shutter piston section 138 end as shown in FIG. 6A. The shutter piston 134 is thereby urged into the shutter actuator body 133 which movement is opposed by and compresses a coil spring 137 that is arranged between a shutter piston flange 134*a* and an inner wall 133*a*, shutter actuator cavity 133 to keep the shutter in a closed or in a safe position, where a hole 126*a* through which shutter 126 is not opposite to the laser rod end, as shown in FIG. 6. This condition continues until, as set out above, the exterior pressure on diaphragm 136 is increased to where, as shown in FIG. 6A, that pressure force is sufficient to overcome the coil spring 137 biasing so as to move the shutter 126 to the attitude shown in FIG. 6A. The external pressure on the diaphragm 136, of course, increases as the device is lowered into the fluid-filled wellbore, the hydrostatic, or external pressure therein increasing with increased depth.

Preferably the coil string 137 is designed so as to exert a force which counteracts external pressure until a predetermined pressure (at an attendant depth) is reached. The spring is then compressed by external pressure until the shutter is fully open, said compression requiring a pressure increase due to vertical travel of five hundred (500) to one thousand (1000) feet whereafter the spring begins to compress.

With the shutter 126 moved to the attitude shown in FIG. 6A, the laser pulse or beam is allowed to pass from the laser rod 120 end into the focus lens 127. As set out above, the spring 137 is so designed that movement of the shutter piston 134, and thereby the shutter 126, will not happen until a preset depth is achieved. In practice, a spring 137 is selected to allow the shutter to open only after the tool has passed through a depth interval of between five hundred (500) to one thousand (1000) feet, thereby reducing an effect of pressure transients. The spring 137, upon retrieval of the initiation assembly 15 from the wellbore 10, moves the shutter actuator body 134 back to the attitude shown in FIG. 6 as the external pressure on diaphragm 133 is reduced, the shutter being fully closed over the selected depth interval of between five hundred (500) and one thousand (1000) feet, prohibiting passage of a laser pulse above a predetermined depth.

The diaphragm 136, as set out above, provides for pressure transmittal and is also to function as a membrane seal, or barrier, for keeping debris from passing into the shutter actuator cavity 133. Which shutter piston 134 end 138 travels in a hole formed through an inset screw 139 that is turned into a threaded opening 140 formed in the initiator assembly body 100. The seal 135 provided in which inset screw 139 prohibiting debris from interfering with the shutter assembly 106 functioning.

In practice, the invention is suspended below an enabling pressure depth whereat the shutter 126 of the initiation assembly 15 is positioned, as shown in FIG. 6A with the shutter 126 positioned to where a hole therethrough is aligned to pass a laser pulse or beam from the laser rod 125. With the extension of plunger 29, as shown in FIG. 3, from the firing head 14 bottom end, the nose 30 thereof will both break the trip wire 117 of the piezoelectric device 103 and will compress the piezoelectric element 111 between its metal caps, or electrodes 112 ends. This piezoelectric element deformation generates an electrical energy pulse that is routed through attendant circuitry 122 and into to fire the spark-gap flashbulbs 123. Which flashbulb firing generates a burst of light that produces a laser pulse output from laser rod 125 end that, after passage through the hole in shutter 126, enters and is focused by focus lens 127 into the fiberoptics connector 128. Which fiberoptic connector 128 can be or include a beam splitting type device, not shown, for splitting and routing the laser beam or pulse to fire a number of initiating charges 132 or a number of connected charges or, as shown in FIG. 1A, a first laser initiated device can, in turn, pass a laser beam to initiate a number of laser initiating devices that, in turn, fire a number of initiating charges, providing a cascading firing. The laser beam or pulse travels through the fiberoptic line 129 or lines to one or more initiating cans 109. FIG. 3 schematically shows the above components, with a plurality of deflagrating or detonating charges 16*a*, 16*b*, and 16*c* shown in broken lines in FIG. 1, and FIG. 1A shows a cascade firing arrangement.

In the embodiment of FIG. 3 it should, however, be understood that the described components are preferably arranged within a container or housing in the initiator assembly body longitudinal cavity 110 so as to be protected from fluid leakage into which cavity. Within such container or housing, however, one or more system gaps or breaks 130 are preferably provided in the fiberoptic line 129 that the laser light must cross to reach the initiating charge 132. Should, however, the cavity 110 become flooded, the laser beam or pulse will not be able to cross which gap or breaks 130, providing an additional safety feature to the invention.

Shown in FIG. 3, the fiberoptic line 129 is fitted through an interface plate 141 that is secured across a bottom portion of the longitudinal cavity 110 providing an initiating can cavity 142. Which interface plate includes a sealing device 143 for sealing against fluid passage into the initiator assembly body cavity 110. The fiberoptic line 129 ends in optical window 131 of the initiating can 109 that contains the initiating charge 132. The laser light received through the optical window creates a rapid heat buildup in the initiating charge that sets off the initiating charge 132, the detonation is passed out of the initiation assembly body 100 bottom and into the charges 16, detonating that charge or charges.

Alternatively to the above, the fiberoptic line 129 may be coupled into a fiberoptic line, not shown, that travels to multiple sites, shown in FIG. 1, each containing an initiating charge that is directed, not shown, into the charge 16, or charges 16*a*, 16*b*, and/or 16*c*, or the like, for setting off or detonating which charge or charges, or as shown in FIG. 1A, a single initiation assembly can be operated to set off or activate a number of firing heads that each operate or fire an initiation assembly that, in turn, fires a number of initiation charges, providing a cascade firing system.

Hereinabove has been set out a preferred embodiment of the present invention in a system for initiating downhole explosive and propellant systems and while preferred forms of the invention have been shown and described herein, it should be understood that the invention may be embodied in other arrangements without departing from the spirit or essential character thereof as shown and described. The present disclosure therefore should be considered in all respects to be illustrative and is made by way of example only and that variations thereto are possible without departing from the subject matter and reasonable equivalency thereof coming within the scope of the following claims, which claims I regard as my invention.

I claim:

1. A system for initiating downhole explosive and propellant systems comprising a firing head having a body for arrangement as a head end of a wellbore operating assembly, and includes a striker plunger for longitudinal extension from which body, on command from a surface operator, which said firing head body includes means for attaching it to an initiating assembly housing such that a nose end of said striker plunger, on extension, will travel into said initiation assembly housing;

conveyance means for connection to said firing head for lowering it from a well head into a wellbore;

an initiation assembly that includes a housing with means for mounting it to said firing head;

a piezoelectric device having conductive ends, and is mounted in said initiation assembly housing so as to be deformed by impact of the extended striker plunger nose to generate an electrical current between which conductive ends, and connecting to circuitry means for electrically coupling said conductive ends to an array of spark-gap flashbulbs that is arranged within said initiation assembly housing, the electrical current from the piezoelectric device deformation to fire said spark-gap flashbulbs;

a laser rod maintained proximate to said array of spark-gap flashbulbs to be excited by their illumination to generate a laser beam output;

a fiberoptics line maintained to receive, the laser beam and to transmit that laser beam to an initiating can means containing an initiating charge;

means at said initiating can means to receive said laser beam and direct it into for detonating said initiating charge; and means for directing the product of the detonation of which initiating charge into, a deflagrating or detonating charge assembly of a downhole explosive or propellant system.

2. A system as recited in claim 1, wherein the firing head body is cylindrical and includes a center longitudinal cavity wherein the striker plunger is maintained to travel longitudinally therein;

means for extending said striker plunger;

locking means for restraining, until released, striker plunger travel; and means controlled by an operator for releasing said locking means.

3. A system as recited in claim 2, wherein the locking means for restraining striker plunger travel are a plurality of dogs that are slidably retained in radial holes formed through the firing head body and into the center longitudinal cavity, an end of each dog extending into said center longitudinal cavity to engage and restrain the striker plunger from longitudinal travel;

a sleeve for encircling said firing head body an inner surface of said sleeve for restraining outwardly radial travel of each said dog, which said sleeve is arranged on said firing head body to be longitudinally movable along the outer surface thereof and includes an inner circumferential cavity that will align with said dogs ends when said sleeve is moved appropriately; and means for restraining sleeve travel along the firing head body, which means for restraining is released by operator action.

4. A system as recited in claim 3, wherein the means for restraining sleeve travel are shear screws fitted through the sleeve and into the firing head body, which shear screws are selected to shear thereacross, freeing the sleeve for longitudinal travel, on application of a set shearing force thereto; and means for applying a shearing force to said sleeve that is of a sufficient magnitude to shear said shear screws.

5. A system as recited in claim 4, wherein the means for applying a shearing force to the sleeve is a weight means dropped along the conveyance.

6. A system as recited in claim 5, wherein the weight means is an arming adaptor that is configured to slide down the conveyance means and span the firing head, said arming adaptor to impact the sleeve top end without shearing the shear screws; and a bar means, that is also arranged to slide down the conveyance means and impact the top of the arming adaptor to provide a force that is transmitted through said arming adaptor to shear said shear screws.

7. A system as recited in claim 6, wherein the means for extending the striker plunger is a spring that is compressed within the firing head body longitudinal cavity, between said striker plunger and a surface of said longitudinal cavity.

8. A system as recited in claim 6, wherein the means for extending the striker plunger, that is formed of a metal, is a solenoid coil means surrounding said striker plunger, which solenoid coil means of receipt of an electrical current, provides a magnetic force of attraction against said striker plunger to extend it longitudinally from the firing housing body; and the conveyance means is a wireline containing conductive wires that link said solenoid coil means to a source of electrical current.

9. A system as recited in claim 8, further including means for retaining the striker plunger in its pre-extension attitude within the firing housing body longitudinal cavity that releases when the solenoid coil means receives electrical current.

10. A system as recited in claim 4, wherein the means for applying a shearing force to the shear screws is a means for applying a hydrostatic pressure to seals of which firing head sleeve, which sleeve has greater top than bottom surface areas adjacent to said sleeve seals the hydrostatic force acting on the seal adjacent to the greater sleeve top surface area with sufficient force to move said sleeve along the firing head body to shear the shear screws and align the sleeve cavity with the dogs ends.

11. A system as recited in claim 10, wherein the means for applying a hydrostatic pressure is a creation of a hydraulic force between the wellbore annulus and the firing head body.

12. A system as recited in claim 11, wherein the conveyance means is a tube system whereon the wellbore finishing assembly is lowered into the wellbore.

13. A system as recited in claim 12, further including a pin means extending between the striker plunger and into the firing head body; and the means for extending said striker plunger is an application of a hydrostatic pressure through the tube system into the firing head longitudinal cavity, above the striker plunger that exerts sufficient force thereon to shear said pin means and extend said striker plunger.

14. A system as recited in claim 2, wherein the means for extending the firing head striker plunger is an initiation charge that is detonated, the force of that detonation acting upon a striker plunger head or top end to extend said striker plunger.

15. A system as recited in claim 14, wherein the initiation charge receives and is detonated by a laser beam transmitted thereto through a fiberoptics line.

16. A system as recited in claim 14, further including a booster charge arranged between the initiation charge and the striker plunger head or top end to be set off or fired by the detonation of said initiation charge; and pin means extending from said striker plunger into the firing head body, which pin is sheared on setting off or firing of said booster charge.

17. A system as recited in claim 1, further including a trip wire arranged to short out terminals that are electrically connected to the piezoelectric device conductive ends, which trip wire is broken by the striker plunger nose end in its extension into the initiating assembly housing, prior to said striker plunger nose end impacting said piezoelectric device.

18. A system as recited in claim 1, wherein the piezoelectric device is a lead Zinconcium Titanate, quartz, or is formed of other piezoelectric material.

19. A system as recited in claim 1, further including circuitry means connected to transmit the electrical current generated by the piezoelectric device deformation to fire the spark-gap flashbulbs; and pyrotechnically coating the spark-gap flashbulb electrodes.

20. A system as recited in claim 1, further including an optical shutter assembly that is mounted in said initiating assembly housing longitudinal cavity, a shutter arm thereof for travel in an opening from without the initiating assembly housing and to said longitudinal cavity, extending across and between the laser rod end and the end of the fiberoptics line, which said shutter arm includes a hole therethrough that is for alignment with the laser rod and fiberoptics line ends when said shutter arm is appropriately extending into said initiating assembly housing;

piston means arranged on the shutter arm opposite end for slidable arrangement between the initiating assembly housing outer surface and the longitudinal cavity and is acted upon by pressure exerted at said initiating assembly housing outer surface to travel inwardly, moving the connected shutter arm inwardly; and a spring biasing means for opposing movement of said shutter arm piston means resulting from said pressure biasing.

21. A system as recited in claim 20, wherein the shutter arm piston means opening at the initiating assembly housing surface is covered by a flexible diaphragm; and the optical shutter assembly spring biasing is a coil spring that is fitted around said shutter arm piston means and between an end wall of said opening in said initiating assembly housing and a flange that extends outwardly from around said shutter arm piston means, which said coil spring is selected to oppose said piston means movement until the initiating assembly is lowered five hundred (500) to one thousand (1000) feet below a predetermined safe depth.

22. A system as recited in claim 1, further including a focus lens means arranged between the laser rod and the fiberoptics line end for focusing the laser beam into said fiberoptics line end.

23. A system as recited in claim 22, wherein the fiberoptics line end for receiving the laser beam includes a fiberoptics connector.

24. A system as recited in claim 1, further including one of more breaks or gaps are provided in the laser beam path; and means arranged at each break or gap for interrupting laser beam passage thereacross in the presence of a fluid other than a gas.

25. A system as recited in claim 1, further including an interface plate arranged across an end of a center longitudinal cavity formed in the initiating assembly housing where through the fiberoptics line is fitted; and the initiating can means containing the initiating charge, connects to said fiberoptics line at optical window that directs the laser beam into the initiating charge, the heat of said laser beam setting off or detonating said initiating charge.

26. A system as recited in claim 1, wherein the initiating can means is arranged in the bottom end of initiating assembly housing and is open into the deflagrating or detonating charge assembly.

27. A system as recited in claim 1, further including means for transmitting the laser beam to one or more initiating can means that are remote to the initiating assembly housing and are arranged to deflagrate or detonate one or more downhole explosives or propellants.

28. A system as recited in claim 1, further including means for splitting the laser beam generated in the initiation assembly and transmitting that split beam through a plurality of fiberoptics lines to separate initiating can means that each contain initiating charges that, when fired, fire a deflagrating or detonating charge.

29. A system as recited in claim 28, further including a source of a laser beam; and means for splitting said laser beam and transmitting each said split laser beam to fire a laser beam initiated firing head whose firing extends the firing head striker plunger into, to operate, the initiation assembly to generate the laser beam.

30. A firing head downhole operating assembly comprising a piezoelectric fired, flashbulb-pumped, lazer initiated system;

a firing head body which includes a striker plunger;

means for connecting said firing head body onto a conveyance;

means for lowering into a wellbore as a part of an operating assembly;

means for connecting said firing head body onto an initiating assembly housing; and means controlled by a surface operator for extending said striker plunger from said firing head body into said initiating assembly, to impact and deform a piezoelectric device, which deformation generates an electrical current that is utilized by said piezoelectric fired, flashbulb-pumped, laser initiated system.

31. A firing head as recited in claim 30, wherein the firing head body is cylindrical and includes a center longitudinal cavity wherein the striker plunger is maintained to travel longitudinally therein;

means for extending said striker plunger;

locking means for restraining, until released, striker plunger travel; and means controlled by an operator for releasing said locking means.

32. A firing head as recited in claim 30, wherein the locking means for restraining striker plunger travel are a plurality of dogs that are slidably retained in radial holes formed through the firing head body and into the center longitudinal cavity, an end of each dog extending into said center longitudinal cavity to engage and restrain the striker from longitudinal travel;

a sleeve for encircling said firing head body, an inner surface of said sleeve for restraining outward radial travel of each said dog, which said sleeve is arranged on said firing head body to be longitudinally movable along the outer surface thereat and includes an inner circumferential cavity that will align with said dogs ends when said sleeve is moved appropriately; and means for restraining sleeve travel along the firing head body, which means for restraining is released by operator action.

33. A firing head as recited in claim 32, wherein the means for restraining sleeve travel are shear screws fitted through the sleeve and into the firing head body, which shear screws are selected to shear thereacross, freeing the sleeve for longitudinal travel, on application of a set shearing force thereto; and means for applying a shearing force to said sleeve that is of sufficient magnitude to shear said shear screws.

34. A firing head as recited in claim 33, wherein the means for applying a shearing force to the sleeve is a weight means dropped along the conveyance.

35. A firing head as recited in claim 34, wherein the weight means is an arming adapter that is configured to slide down the conveyance means and span the firing head, said arming adapter to impact the sleeve top end without shearing the shear screws; and a bar means, that is also arranged to slide down the conveyance means and impact the top of the arming adapter to provide a force that is transmitted through said arming adapter to shear said shear screws.

36. A firing head as recited in claim 35, wherein the means for extending the striker plunger is a spring that is compressed within the firing head body longitudinal cavity, between said striker plunger and a surface of said longitudinal cavity.

37. A firing head as recited in claim 35, wherein the means for extending the striker plunger, that is formed of metal, is a solenoid coil means surrounding said striker plunger, which solenoid coil means, on receipt of an electrical current, provides a magnetic force of attraction against said striker plunger to extend it longitudinally from the firing housing body; and the conveyance means is a wireline containing conductive wires that link said solenoid coil means to a source of electrical current.

38. A firing head as recited in claim 37, further including means for retaining the striker plunger in its pre-extension attitude within the firing housing body longitudinal cavity that releases when the solenoid coil means receives electrical current.

39. A firing head as recited in claim 33, wherein the means for applying a shearing force to the shear screws is a means for applying a hydrostatic pressure to seals of which firing head sleeve, which sleeve has greater top than bottom surface areas and adjacent to said sleeve seals the hydrostatic force acting on that seal adjacent to the greater sleeve top surface area with sufficient force to move said sleeve along the firing head body to shear the shear screws and move the sleeve and align the sleeve cavity with the dogs ends.

40. A firing head as recited in claim 39, wherein means for applying a hydrostatic pressure is a creation of a hydraulic force between the wellbore annulus and the firing head body.

41. A firing head as recited in claim 40, wherein the conveyance means is a tube system whereon the wellbore finishing assembly is lowered into the wellbore.

42. A firing head as recited in claim 41, further including a pin means extending between the striker plunger and into the firing head body; and the means for extending said striker plunger is an application of a hydrostatic pressure through the tube system into the firing head longitudinal cavity, above the striker plunger that exerts sufficient force thereon to shear said pin means and extend said striker plunger.

43. A firing head as recited in claim 31, wherein the means for extending the firing head striker plunger is an initiation charge that is detonated, the force of that detonation acting upon a striker plunger head or top end to extend said striker plunger.

44. A firing head as recited in claim 43, wherein the initiation charge receives and is detonated by a laser beam transmitted thereto through a fiberoptics line.

45. A system as recited in claim 43, further including a booster charge arranged between the initiation charge and the striker plunger head of top end to be set off or fired by the detonation of said initiation charges; and pin means extending from said striker plunger into the firing head body, which pin is sheared on setting off or firing of said booster charge.

* * * * *

UNITED STATES PATENT AND TRADEMARK OFFICE
CERTIFICATE OF CORRECTION

PATENT NO. : 5,322,019

DATED : June 21, 1994

INVENTOR(S) : Craig R. Hyland

It is certified that error appears in the above-identified patent and that said Letters Patent is hereby corrected as shown below:

On the title page: Item

[76] Inventor: Craig R. Hyland, 3757 Adams Rd., Magna, Utah 84044 and Item

[21] Appl. No.: 743,822 add Item

[73] Assignee: Terra Tek, Inc., 420 Wakara Way Salt Lake City, Utah 84108

Signed and Sealed this

Eighth Day of November, 1994

*Attest:*

Bruce Lehman

BRUCE LEHMAN

*Attesting Officer*

*Commissioner of Patents and Trademarks*